US008538056B2

(12) United States Patent
Ishibashi et al.

(10) Patent No.: US 8,538,056 B2
(45) Date of Patent: Sep. 17, 2013

(54) HEARING AID

(75) Inventors: Masahiro Ishibashi, Ehime (JP); Yosimasa Simogochi, Ehime (JP); Takeshi Umeda, Ehime (JP); Takashi Fujikawa, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/521,140

(22) PCT Filed: Jan. 13, 2012

(86) PCT No.: PCT/JP2012/000186

§ 371 (c)(1),
(2), (4) Date: Jul. 9, 2012

(87) PCT Pub. No.: WO2012/114644

PCT Pub. Date: Aug. 30, 2012

(65) Prior Publication Data

US 2012/0321114 A1 Dec. 20, 2012

(30) Foreign Application Priority Data

Feb. 25, 2011 (JP) ..... 2011-039795

(51) Int. Cl.
*H04R 25/00* (2006.01)

(52) U.S. Cl.
USPC ..... 381/330; 381/381; 381/382

(58) Field of Classification Search
USPC ..... 381/322, 330, 327, 328, 380, 381, 381/382
See application file for complete search history.

(56) References Cited

U.S. PATENT DOCUMENTS 7,720,244 B2 * 5/2010 Espersen et al. ..... 381/330
8,311,253 B2 * 11/2012 Silvestri et al. ..... 381/328

(Continued)

FOREIGN PATENT DOCUMENTS

JP 2008-512882 4/2008
JP 2009-55122 3/2009

(Continued)

OTHER PUBLICATIONS

International Search Report issued Feb. 14, 2012 in International (PCT) Application No. PCT/JP2012/000186.

(Continued)

*Primary Examiner* — Mohammad Islam
*Assistant Examiner* — Phylesha Dabney
(74) *Attorney, Agent, or Firm* — Wenderoth, Lind & Ponack, L.L.P.

(57) ABSTRACT

A hearing aid (100) comprises a body case (2) that is worn behind an ear (1), a sound conductor (3) that is linked at one end to the body case (2) and is linked at the other end to an earpiece (6), and an engaging component (8) for holding the earpiece linked to the other end of the sound conductor in the external auditory canal (7) of the ear (1). The engaging component (8) is made up of a first arc part (8*a*) disposed on the earpiece (6) side, a second arc part (8*b*) that is larger than the first arc part (8*a*) and is disposed opposite the first arc part (8*a*), a first linking part (8*c*) that links one end of the first arc part (8*a*) and one end of the second arc part (8*b*), and a second linking part (8*d*) that links the other end of the first arc part (8*a*) and the other end of the second arc part (8*b*). The second linking part (8*d*) has a shape such that its center part protrudes toward the first linking part (8*c*). This constitution allows the hearing aid (100) to be put on more easily.

7 Claims, 4 Drawing Sheets

(56) References Cited

U.S. PATENT DOCUMENTS

| | | | | |
|---|---|---|---|---|
| 2002/0096391 | A1* | 7/2002 | Smith et al. | 181/135 |
| 2005/0002539 | A1 | 1/2005 | Nielsen | |
| 2006/0215864 | A1 | 9/2006 | Espersen et al. | |
| 2009/0052719 | A1 | 2/2009 | Fujiwara et al. | |
| 2010/0017006 | A1 | 1/2010 | Clausen et al. | |

FOREIGN PATENT DOCUMENTS

| | | |
|---|---|---|
| JP | 2009-89334 | 4/2009 |
| WO | 2007/090407 | 8/2007 |

OTHER PUBLICATIONS

Written Opinion of the International Searching Authority issued Feb. 14, 2012 in International (PCT) Application No. PCT/JP2012/000186.

Supplementary European Search Report issued Apr. 18, 2013 in corresponding European Application No. EP 12 72 6568.4.

* cited by examiner

HEARING AID

TECHNICAL FIELD

The present invention relates to a behind-the-ear type of hearing aid.

BACKGROUND ART

A conventional hearing aid of this type comprises a body case that is worn behind an ear, and a string-shaped sound conductor that is linked at one end to this body case and at the other end to an earpiece, and there is a known example in which a string-shaped engaging part that engages with the antitragus of the ear is attached to the other end of the sound conductor (see Patent Literature 1, for example). With this hearing aid, the body case is worn behind an ear, and the earpiece is inserted into the external auditory canal, after which the engaging part is engaged with the antitragus of the ear, which keeps the earpiece from coming out of the external auditory canal.

With the above hearing aid, the string-shaped engaging part is designed to be longer because the size of an ear varies with the individual wearing the hearing aid. Therefore, when a person with small ears wears the hearing aid, the distal end side of the engaging part is cut off with scissors or another such cutting tool to adjust the length. In other words, the engaging part has to be cut with the above-mentioned cutting tool in order to match it to the size of the ear of the individual wearing the hearing aid, and this made the fitting of the hearing aid more difficult.

In view of this, it has been proposed that a ring-shaped engaging part that engages with the tragus be attached to the other end of the sound conductor of the hearing aid (see Patent Literature 2, for example). With this hearing aid, one end of a string-shaped engaging part is linked to the other end to form a ring, and the size of this ring can be varied by retracting or extending the other end. This constitution can accommodate differences in the size of the ears of the individuals wearing the hearing aid.

CITATION LIST

Patent Literature

Patent Literature 1: US Laid-Open Patent Application 2005/0002539

Patent Literature 2: US Laid-Open Patent Application 2006/0215864

SUMMARY

Technical Problem

However, as mentioned above, the hearing aid discussed in the above-mentioned Patent Literature 2 requires the other end of the string-shaped part to be retracted or extended. Thus, in the actual work, after the fitting of the ring-shaped engaging part has been checked in a state in which the hearing aid is worn on one ear, the hearing aid has to be taken off again, and the work of retracting or extending the other end of the string-shaped engaging part must be repeated until the right size is reached, and this complicates the fitting work.

In view of this, it is an object of the present invention to make it easier to fit a hearing aid.

Solution to Problem

To solve the stated problem, one aspect of the present invention provides a hearing aid comprising a body case configured to be worn behind an ear, a sound conductor linked at one end to the body case and linked at the other end to an earpiece, and an engaging component configured to hold the earpiece linked to the other end of the sound conductor in the external auditory canal of the ear, wherein the engaging component has a ring shape. The ring shape is constituted by a first arc part disposed on a earpiece side, a second arc part that is larger than the first arc part and is disposed opposite the first arc part, a first linking part that links one end of the first arc part and one end of the second arc part, and a second linking part that links the other end of the first arc part and the other end of the second arc part. The second linking part has a shape such that a center part of the second linking part protrudes toward the first linking part.

Advantageous Effects

The present invention makes it easier to fit a hearing aid.

DESCRIPTION OF EMBODIMENTS

An embodiment of the present invention will now be described in detail through reference to the drawings.

1 Embodiment 1

1.1 Hearing Aid 100

Figure 1:
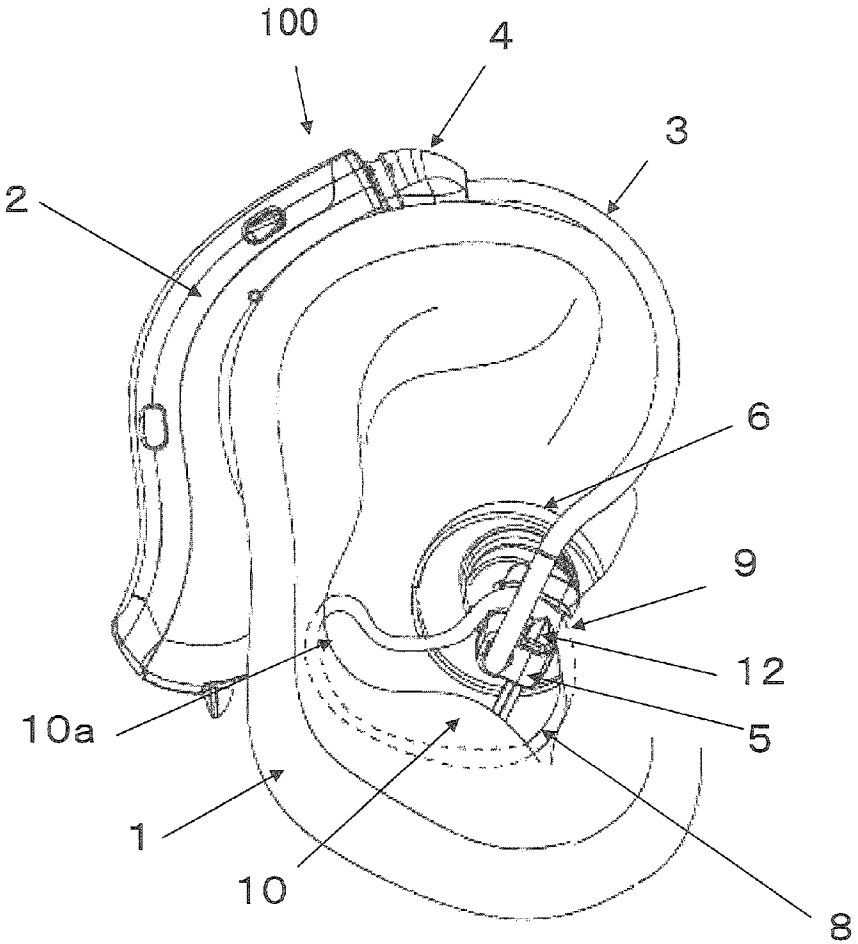
FIG. 1 is a side view of a state in which the hearing aid pertaining to an embodiment of the present invention has been put on an ear.
Figure 2:
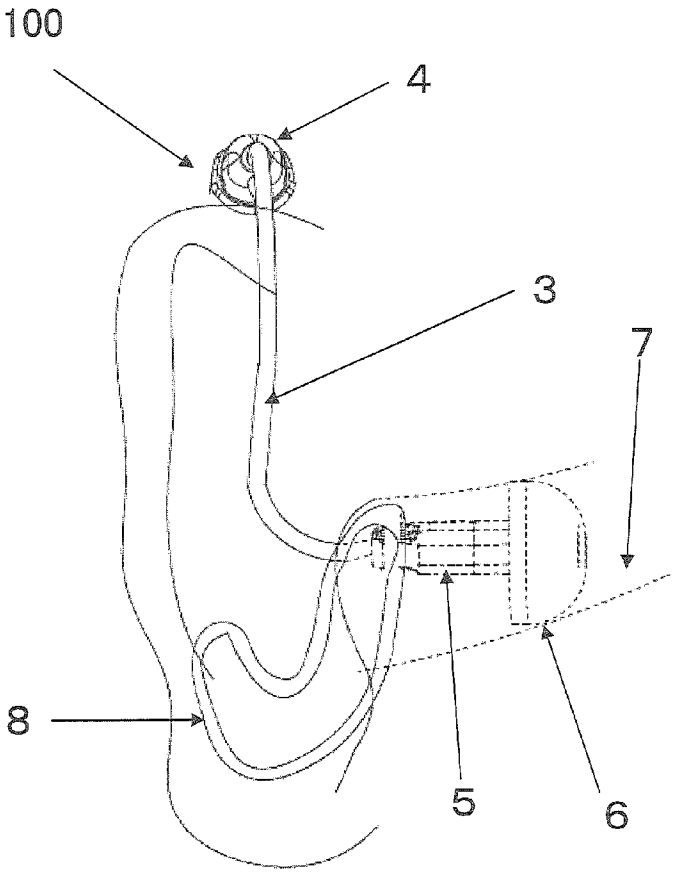
FIG. 2 is a front view of a state in which the hearing aid pertaining to the above-mentioned embodiment has been put on an ear.

FIG. 1 is a side view of a state in which the hearing aid 100 pertaining to one embodiment of the present invention has been put on an ear. FIG. 2 is a front view of the same. The hearing aid 100 is worn on an ear 1 in a state in which its body case 2 is hooked behind the ear 1.

The hearing aid 100 comprises a string-shaped sound conductor 3, a coupler 4, an earpiece adapter 5, an earpiece 6, and a ring-shaped engaging component 8.

The coupler 4 is provided at the top part of the body case 2, and is linked to one end of the string-shaped sound conductor 3.

The earpiece adapter 5 is attached to the other end of the sound conductor 3, and is linked to the earpiece 6.

The earpiece 6 in this embodiment is structured such that every part of it is inserted into the external auditory canal 7 of the ear 1, as shown in FIG. 2.

When the hearing aid 100 is put on the ear 1, as can be seen from FIG. 1, the string-shaped sound conductor 3 extends from the end linked to the coupler 4 at the upper part of the body case 2, to the outside of the external auditory canal 7, tracing an approximate arc. From there, as can be seen in FIG. 2, the sound conductor 3 gently curves toward the external auditory canal 7.

The ring-shaped engaging component 8 is attached to the earpiece adapter 5. This engaging component 8 comes into contact with the tragus 9, the antitragus 10, and then the antihelix 10*a*, and as a result the earpiece 6 is stably fixed to the ear 1.

1.2 Engaging Component 8

The engaging component 8 will now be described through reference to FIG. 3. The engaging component 8 is made of a deformable, soft material. Silicone rubber or the like can be used, for example.

The engaging component 8 has a ring shape and is made up of a convex small arc 8*a* (an example of a first arc part) disposed on the earpiece 6 side, a convex large arc 8*b* (an example of a second arc part) that is larger than the convex small arc 8*a* and is disposed opposite the convex small arc 8*a*, a front side 8*c* (an example of a first linking part) that links the front end of the convex small arc 8*a* and the front end of the convex large arc 8*b*, and a rear side 8*d* (an example of a second linking part) that links the rear end of the convex small arc 8*a* and the rear end of the convex large arc 8*b*. The rear side 8*d* has a concave shape in which its center part protrudes toward the front side 8*c*.

A coupler 11 having a shape that protrudes into the ring shape is molded integrally with the convex small arc 8*a* of the engaging component 8.

Figure 4:
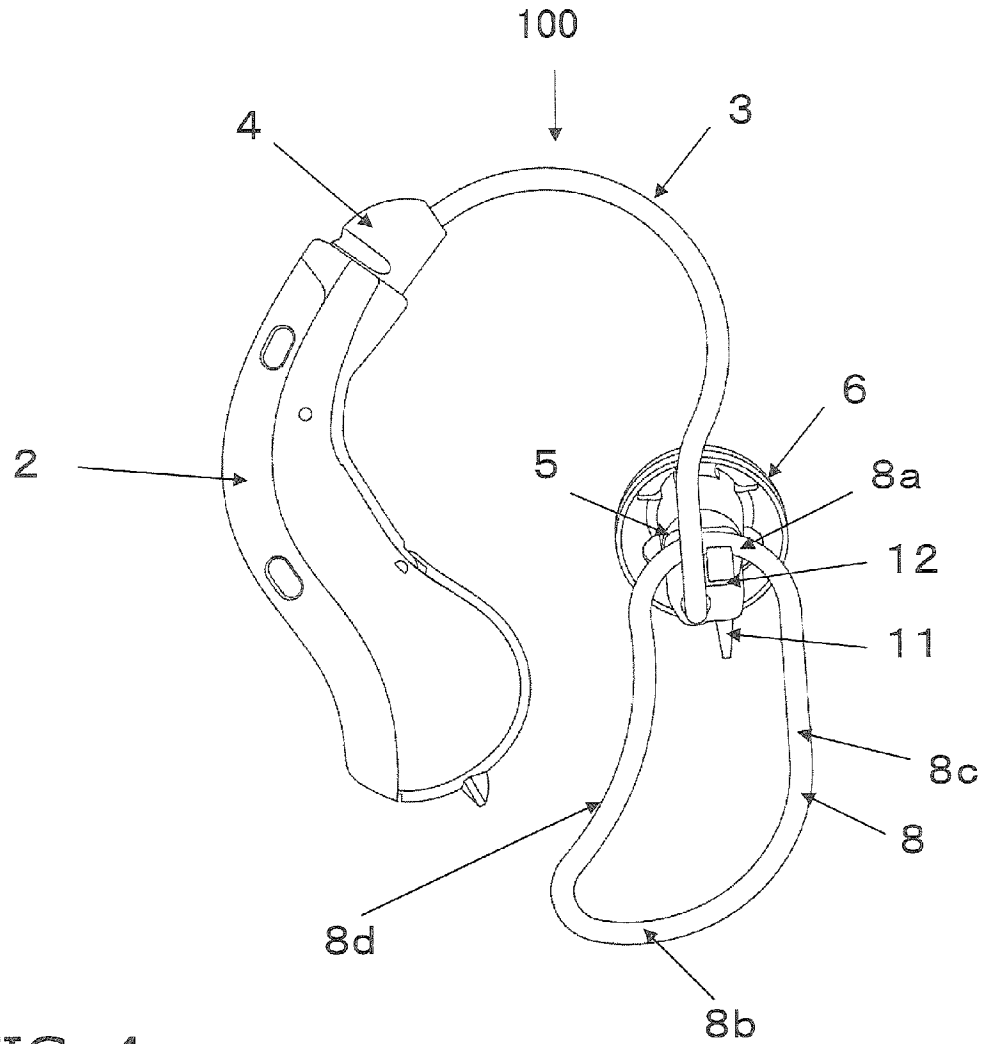
FIG. 4 is a side view of a hearing aid in which the engaging component has been mounted.

FIG. 4 is a diagram of the state when the engaging component 8 has been attached to the hearing aid 100.

The engaging component 8 is coupled to the earpiece adapter 5 by plugging the earpiece adapter 5 into a hole 12 disposed at the entrance to the external auditory canal 7. In a state in which the engaging component 8 has been coupled to the earpiece adapter 5, the earpiece 6 is positioned in the deepest part of the external auditory canal 7, and next to the earpiece adapter 5, the engaging component 8 is disposed around the entrance to the external auditory canal 7 (see FIG. 2).

1.3 Using the Hearing Aid 100

When the hearing aid 100 is put on the ear 1, first the body case 2 is disposed behind the ear 1 as shown in FIG. 1, after which the earpiece 6 is inserted into the external auditory canal 7 as shown in FIG. 2. When the engaging component 8 is then put inside the ear 1 as shown in FIG. 2, first the front side 8*c* is put on the rear side of the tragus 9. Next, the convex large arc 8*b* is put on the rear side of the antitragus 10. As can be seen from a comparison of FIGS. 4 and 1, this deforms the convex large arc 8*b* by pushing it toward the convex small arc 8*a* side. At this point, adjustment in the lengthwise direction of the engaging component 8 is performed so as to match the size of the individual's ear.

Thus, the reason the convex large arc 8*b* of the engaging component 8 is deformed in a state of being pushed to the convex small arc 8*a* side is that there is a concave shape in which the center part of the rear side 8*d* protrudes toward the front side 8*c*. The rear side 8*d* has a shape that allows displacement to the front side 8*c*, or a configuration that allows deformation by bending, so that the upper end (the convex small arc 8*a* side) and the lower end (the convex large arc 8*b*) move closer together.

1.4 Effect

In this embodiment, the engaging component 8 of the hearing aid 100 has a ring shape constituted by the convex small arc 8*a* disposed on the earpiece 6 side, the convex large arc 8*b* that is larger than the convex small arc 8*a* and is disposed opposite the convex small arc 8*a*, the front side 8*c* that links the front end of the convex small arc 8*a* and the front end of the convex large arc 8*b*, and the rear side 8*d* that links the rear end of the convex small arc 8*a* and the rear end of the convex large arc 8*b*. The rear side 8*d* has a concave shape in which the center part protrudes toward the front side 8*c*. With this configuration, there is deformation in the direction in which the rear side 8*d* of the engaging component 8 is bent, to match the size of the individual wearing the hearing aid 100.

That is, regardless of the size of the ears of the individual wearing the hearing aid 100, the size of the engaging component 8 can be adjusted by displacing the rear side 8*d* of the engaging component 8 in the bending direction, merely by putting the engaging component 8 on the ear. As a result, the fitting of the hearing aid 100 can be simplified.

Figure 3:
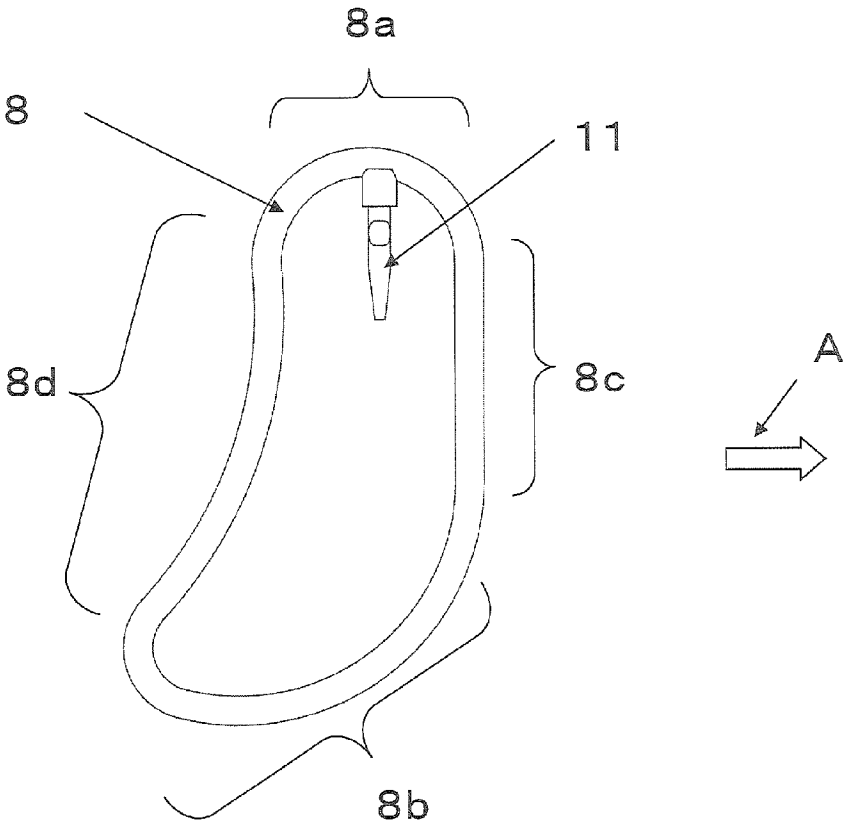
FIG. 3 is a side view of the engaging component of the hearing aid.

Also, in this embodiment, when the rear side 8*d* of the engaging component 8 is displaced in the bending direction, momentum comes into play that moves the convex small arc 8*a* and the front side 8*c* toward the front of the ear 1 (the direction of the arrow A in FIG. 3). As a result, the front side 8*c* is pressed against the rear side of the tragus 9 as shown in FIG. 1. In this state, the front side 8*c* is pressed against the rear side of the tragus 9, while the convex large arc 8*b* is pressed against the rear side of the antitragus 10 as shown in FIG. 1. Consequently, the engaging component 8 is held to the ear 1 in a stable state, and the earpiece adapter 5 and the earpiece 6 that are engaged with the engaging component 8 are held in the external auditory canal 7 in an extremely stable state.

1.5 Features

As discussed above, the hearing aid pertaining to the above embodiment comprises a body case that is worn behind an ear, a sound conductor 3 that is linked at one end to the body case and is linked at the other end to an earpiece, and an engaging component for holding the earpiece linked to the other end of the sound conductor in the external auditory canal of the ear. The engaging component has a ring shape and is made up of a first arc part that is disposed on the earpiece side, a second arc part that is larger than the first arc part and is disposed opposite the first arc part, a first linking part that links one end of the first arc part and one end of the second arc part, and a second linking part that links the other end of the first arc part and the other end of the second arc part. The second linking part has a shape such that its center part protrudes toward the first linking part. This constitution allows the hearing aid to be put on more easily.

2 Other Embodiments

The present invention is not limited to the above embodiment, of course, and modifications are possible without departing from the gist of the invention.

For example, the sound conductor 3 is formed by a sound conducting pipe in the above embodiment, but it may instead be formed by a sound signal transmission wire that transmits sound with electrical signals.

Industrial Applicability

The present invention can be utilized as a hearing aid.

REFERENCE SIGNS LIST

1 ear
2 body case
3 sound conductor
4 coupler
5 earpiece adapter
6 earpiece
7 external auditory canal
8 engaging component
8*a* convex small arc
8*b* convex large arc
8*c* front side
8*d* rear side
9 tragus
10 antitragus
10*a* antihelix
11 coupler
12 hole
100 hearing aid

The invention claimed is:

1. A hearing aid, comprising:

a body case configured to be worn behind an ear;

a sound conductor linked at one end to the body case and linked at the other end to an earpiece; and an engaging component configured to hold the earpiece linked to the other end of the sound conductor in the external auditory canal of the ear, wherein the engaging component has a ring shape, the ring shape is constituted by a first arc part disposed on a earpiece side, a second arc part that is larger than the first arc part and is disposed opposite the first arc part, a first linking part that links one end of the first arc part and one end of the second arc part, and a second linking part that links the other end of the first arc part and the other end of the second arc part, and the second linking part has a shape such that a center part of the second linking part protrudes toward the first linking part.

2. The hearing aid according to claim 1, wherein the first linking part of the engaging component is substantially linear.

3. The hearing aid according to claim 1, wherein the engaging component includes a coupler configured to hold the other end of the sound conductor.

4. The hearing aid according to claim 1, wherein the sound conductor is formed from a sound conducting pipe.

5. The hearing aid according to claim 1, wherein the sound conductor is formed from a sound signal transmission wire.

6. The hearing aid according to claim 1, wherein the engaging component is made from a deformable material.

7. The hearing aid according to claim 1, wherein the second linking part of the engaging component has such a shape as to displace toward the first linking part when the second arc part has been pushed toward the first arc part.

* * * * *